US007665622B2

(12) United States Patent
Anderson et al.

(10) Patent No.: US 7,665,622 B2
(45) Date of Patent: Feb. 23, 2010

(54) RAILROAD CAR COUPLER CENTERING DEVICE

(75) Inventors: John D. Anderson, Aurora, IL (US); Walter J. Peach, Montgomery, IL (US)

(73) Assignee: Standard Car Truck Company, Park Ridge, IL (US)

( * ) Notice: Subject to any disclaimer, the term of this patent is extended or adjusted under 35 U.S.C. 154(b) by 357 days.

(21) Appl. No.: 11/610,990

(22) Filed: Dec. 14, 2006

(65) Prior Publication Data

US 2007/0138120 A1 Jun. 21, 2007

Related U.S. Application Data

(60) Provisional application No. 60/750,960, filed on Dec. 15, 2005.

(51) Int. Cl.
*B61G 9/00* (2006.01)

(52) U.S. Cl. ..... 213/20

(58) Field of Classification Search ..... 213/12, 213/16–21

See application file for complete search history.

(56) References Cited

U.S. PATENT DOCUMENTS 2,808,906 A 10/1957 Busch
3,365,078 A 1/1968 Hathorn et al.
3,445,005 A * 5/1969 Kulieke, Jr. et al. ..... 213/20
3,642,149 A 2/1972 Chierici et al.
3,809,251 A 5/1974 Chierici et al.
3,933,252 A 1/1976 Murphy et al.
4,003,316 A 1/1977 Monselle
4,030,613 A 6/1977 Chierici
4,120,404 A 10/1978 Chierici et al.
4,131,069 A 12/1978 List
4,133,434 A 1/1979 Chierici et al.

(Continued)

OTHER PUBLICATIONS

"High-cube cars have created a market for coupler positioning devices" published in Railway Locomotives and Cars, Jan. 1973.

(Continued)

*Primary Examiner*—S. Joseph Morano
*Assistant Examiner*—Robert J McCarry, Jr.
(74) *Attorney, Agent, or Firm*—K&L Gates LLP

(57) ABSTRACT

A railroad car coupler centering device including in one embodiment a spreader beam mountable to the striker at one end of a railroad car, a right side centering spring rotatably connected to the spreader beam by a hinge, and a left side centering spring rotatably connected to the spreader beam by a hinge. The first or right side centering spring is moveable to and between a coupler engaged position and a coupler disengaged position. In the coupler engaged position, the right side centering spring is positioned to engage the right side of the coupler and to bias the coupler to a central position. In the coupler disengaged position, the right side centering spring allows the coupler to move from the center position to the right. Similarly, the left side centering spring is moveable to and between a coupler engaged position and a coupler disengaged position. In the coupler engaged position, the left side centering spring is positioned to engage the left side of the coupler and to bias the coupler to the central position. In the coupler disengaged position, the left side centering spring allows the coupler to move from the center position to the left.

27 Claims, 20 Drawing Sheets

U.S. PATENT DOCUMENTS

| | | | |
|---|---|---|---|
| 4,244,297 | A | 1/1981 | Monselle |
| 4,248,158 | A | 2/1981 | Chierici et al. |
| 4,455,946 | A | 6/1984 | List |
| 4,655,143 | A | 4/1987 | List |
| 4,771,703 | A | 9/1988 | Brodeur |
| 4,784,068 | A | 11/1988 | Burke |
| 4,889,054 | A | 12/1989 | List |
| 4,913,062 | A | 4/1990 | Burke |
| 4,938,152 | A | 7/1990 | List |
| 5,005,489 | A | 4/1991 | Terlecky |
| 5,031,544 | A | 7/1991 | Braemert et al. |

OTHER PUBLICATIONS

Holland Coupler Positioner brochure published by Holland Freight Equipment Div. prior to Dec. 15, 2005.

"A Users Guide to . . . " published in The Car and Locomotive Cyclopedia prior to Dec. 15, 2005.

* cited by examiner

RAILROAD CAR COUPLER CENTERING DEVICE

PRIORITY CLAIM

This application is a non-provisional of, and claims priority to and the benefit of U.S. Provisional Patent Application Ser. No. 60/750,960, filed Dec. 15, 2005, the entire contents of which are incorporated herein by reference.

BACKGROUND

Thousands of adjacent freight railroad cars are connected and unconnected everyday in railroad yards to form freight trains for travel to different destinations. The corresponding couplers of two adjacent railroad cars which are being connected must be correctly positioned or aligned prior to being coupled for proper coupling. During the coupling process, if the couplers of two adjacent railroad cars being connected are not aligned (i.e., are miscoupled), one or more of the couplers, strikers, bell mouths, brake hoses, angle cocks, end sills and other components of one or both of the railroad cars can be damaged. For example, if the couplers are not aligned, the ends of the couplers of either or both railroad cars can engage the frame of the other railroad car (instead of the coupler of the other railroad car) which can be damaged. This damage can be extensive. The couplers and other components of thousands of railroad cars in the United States are damaged each year due to improper alignment of couplers. This problem is magnified for railroad cars having wide bell mouth openings and long shank couplers.

Damage to couplers and other components occurs in part because railroad cars often roll through curved tracks before being connected along straight tracks. Railroad yards often have coupling areas wherein railroad cars are directed along a single main line railroad track to a switch. The switch leads to two or more railroad destination tracks. Some railroad yards have many destination tracks connected to a single main line track. Some railroad yards have multiple main line tracks connected to multiple destination tracks. Each railroad car is directed from the single main line track through the switch to one of the destination tracks to form different freight trains (which will go to different destinations). To provide for these multiple tracks, the switches lead to the curved track portions. As the railroad car moves on or through a curved track portion, one or more of the coupler(s) of the railroad car can shift from a central position to an off center position (i.e., to the right or left of center). When this occurs, depending on the position of the coupler of the opposing railroad car being coupled, the couplers may not be aligned and may by-pass each other during the coupling process. This occurs even though the adjacent railroad cars are often coupled on a straight portion of the destination track.

FIGS. 16A to 16C diagrammatically illustrate one example of how couplers can become misaligned and thus by-pass each other during the connection or coupling process in a railroad yard. FIG. 16A illustrates Railroad Car A and Railroad Car B on the straight portions of the tracks in a railroad yard. The couplers of both cars are centered. FIG. 16B illustrates Railroad Car B moving from the main line section of the track on or through the curved portion of the track at the switch and that during such movement to the left the coupler tends to move to the right relative to Railroad Car B. The coupler on Railroad Car A remains centered. FIG. 16C illustrates Railroad Car B about to be coupled with Railroad Car A and that the coupler of Railroad Car B remains positioned toward the right side of Railroad Car B. The couplers on Railroad Car A and Railroad Car B are therefore misaligned and will by-pass each other. This generally illustrated problem is often magnified because many railroad yards are hump yards, wherein railroad cars, such as Railroad Car B, gain speed prior to coupling to enhance the coupling process.

FIG. 17A diagrammatically illustrates adjacent railroad cars with couplers in alignment. FIGS. 17B to 17F diagrammatically illustrate adjacent railroad cars with misaligned couplers. These figures illustrate that misalignment can occur in various different manners. Such misaligned couplers and components on such railroad cars are subject to being damaged during the coupling process. More specifically, FIGS. 17B to 17F diagrammatically illustrate railroad cars with couplers misaligned in the same direction and railroad cars with couplers misaligned in the different directions.

Due to these problems, it is well known that couplers often must be manually positioned or aligned after the railroad cars being coupled are moved adjacent to each other and prior to the actual coupling of the two adjacent railroad cars. Manually moving and adjusting the couplers at this point can and sometimes does result in injury to the railroad yard workers. Additionally, this manual adjustment during the coupling process can be a time consuming task and can slow down the coupling process.

Various apparatus have been proposed for positioning couplers. For instance, U.S. Pat. Nos. 3,809,251 and 3,642,149 disclose coupler positioning devices. Such coupler positioning devices are not widely used because they have various disadvantages. Such coupler positioning devices are fairly complicated and are subject to failure. These coupler positioning devices also add a significant amount of weight to each of the railroad cars, thus decreasing fuel efficiency. These coupler positioning devices also do not work properly on a consistent reliable basis. These coupler positioning devices are also relatively expensive to manufacture, install and maintain.

Accordingly, there is a need for a reliable, simple, durable, inexpensive, lightweight, easily installed, easily operable device for facilitating the alignment of couplers on opposing adjacent railroad cars prior to and during the connection or coupling process of those railroad cars.

SUMMARY

The present invention provides a railroad car coupler centering device, and more particularly a device for maintaining a coupler of a railroad car in a desired central or substantially central position. The present invention also provides a railroad car having at least one centering device and preferably at least two centering devices (i.e., one at each end). The present invention also provides a plurality of railroad cars having centering devices which assist in the coupling of the railroad cars to each other.

One embodiment of the coupler centering device of the present invention includes a spreader beam configured to be suitably mounted to the top of the striker at one end of a railroad car, a first or right side centering member or spring pivotally connected to the spreader beam by a first hinge, and a second or left side centering member or spring pivotally connected to the spreader beam by a second hinge. The right side centering member or spring is moveable to and between a coupler engaged position and a coupler disengaged position. In the coupler engaged position, the right side centering member or spring is positioned and configured to engage the right side of the coupler shank when the coupler moves to the right and is configured to bias the coupler to a central position when the coupler moves to the right. In the coupler disengaged position, the right side centering member or spring allows the coupler to move from the central position to the right. Similarly, the second or left side centering member or spring is moveable to and between a coupler engaged position and a coupler disengaged position. In the coupler engaged position, the left side centering member or spring is positioned and configured to engage the left side of the coupler shank when the coupler moves to the left and is configured to bias the coupler to the central position when the coupler moves to the left. In the coupler disengaged position, the left side centering spring allows the coupler to move from the central position to the left. It should be appreciated that the present invention thus allows for the manual movement of the couplers on one or both cars as necessary when the cars must be coupled on a curved section of track.

The coupler centering device when in the fully engaged position (i.e., both the right and left side centering members or springs being in their respective coupler engaged positions) maintains an uncoupled coupler of a railroad car in a centered or substantially centered relative to the railroad car when the railroad car moves along either straight or curved track. Thus, during the connecting or coupling process, the right and left side centering members or springs can be positioned in the coupler engaged positions to prevent substantial movement of the coupler. If the railroad car moves around the track, the coupler centering device will prevent the coupler from moving to a misaligned position. This will prevent bypassing of the couplers and damage to the couplers, strikers, bell mouths, brake hoses, angle cocks, end sills and other components of the adjacent railroad cars.

For example, prior to coupling, when a railroad car (such as Railroad Car B in FIG. 17A) is on the main line track, the right and left side centering members or springs can be placed in their respective coupler engaged positions. When the railroad car moves on or through the curved track and during the subsequent coupling process, the right and left side centering member or springs maintain the uncoupled coupler in a centered position. Accordingly, the couplers of Railroad Car A and Railroad Car B would be aligned during the coupling process and damage to these couplers and other components is avoided.

It should be appreciated that the right and left side centering members or springs are configured such that the right and left side centering members or springs can remain in the coupler engaged positions because they allow and do not interfere with the movement of coupled couplers during normal movement of the railroad cars through curves or curved track.

The right and left side centering members or springs are also each independently moveable (i.e., pivotable upwardly about the respective hinges) to coupler disengaged positions to allow for the manual movement of the couplers to the left and to the right. In other words, if the coupler needs to be moved to right, the right side centering member or spring can be manually moved out of the way (i.e., lifted out of the way by upwardly pivoting) about the hinge to its coupler disengaged position. Likewise, if the coupler needs to be moved to the left, the left side centering member or spring can be easily manually moved out of the way (i.e., lifted out of the way by upwardly pivoting) about the hinge to its coupler disengaged position. This facilitates coupling on a curved section of track.

In one embodiment, if either of the centering springs is in the lifted or coupler non-engaged position, the hinge is configured such that movement of the railroad car generally will cause the centering member or spring to move downwardly to one of two positions. The first position is the coupler engaged position. The second position is on top of the coupler if the coupler is under the respective centering member or spring until the coupler is moved or moves out of the way (i.e., such as by moving the railroad car from a curved section of track to a straight section of track).

It should be appreciated that each railroad car preferably would have a coupler centering device at each end of the railroad car (i.e., one for each coupler) and that adjacent railroad cars being coupled would have coupler centering devices for the respective aligned couplers of the railroad cars being connected. It should also be appreciated that the railroad car coupler can continue to be greased and/or work with suitable wear plates in a conventional manner in accordance with operation of the present invention.

One advantage of the present invention is to provide a reliable railroad car coupler centering device.

Another advantage of the present invention is to provide an inexpensive railroad car coupler centering device.

Another advantage of the present invention is to provide a lightweight railroad car coupler centering device.

Another advantage of the present invention is to provide a easily installed and maintained railroad car coupler centering device.

Another advantage of the present invention is to provide a simple easily operable railroad car coupler centering device.

Another advantage of the present invention is to provide a railroad car coupler centering device which reduces damage to railroad cars during coupling.

Another advantage of the present invention is to provide a railroad car coupler centering device which reduces potential injuries to rail yard workers.

Additional features and advantages of the present invention are described in, and will be apparent from, the following Detailed Description of the Invention and the figures.

DETAILED DESCRIPTION

Figure 1:
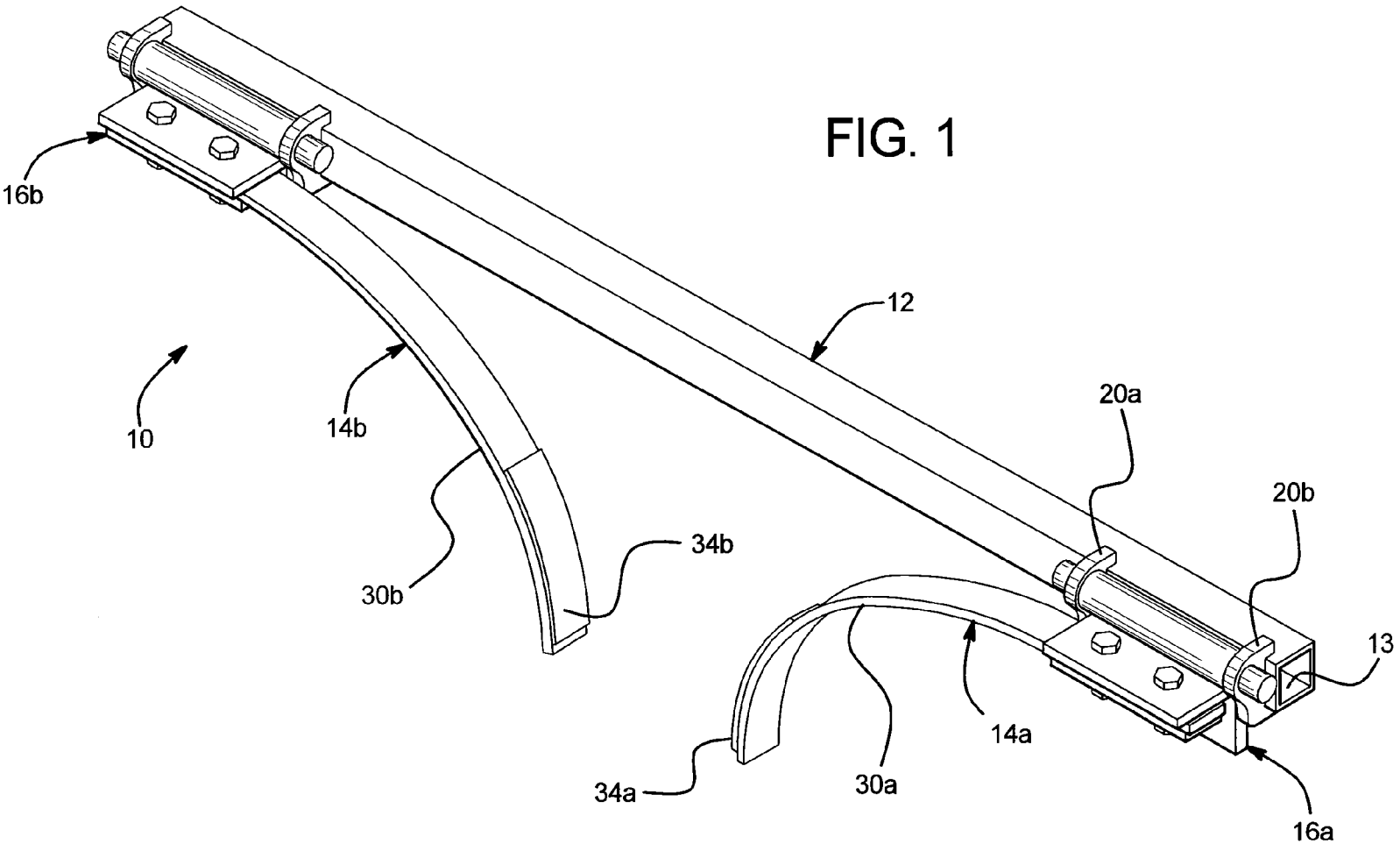
FIG. 1 is a perspective view of one embodiment of the railroad car coupler centering device of the present invention.
Figure 2:
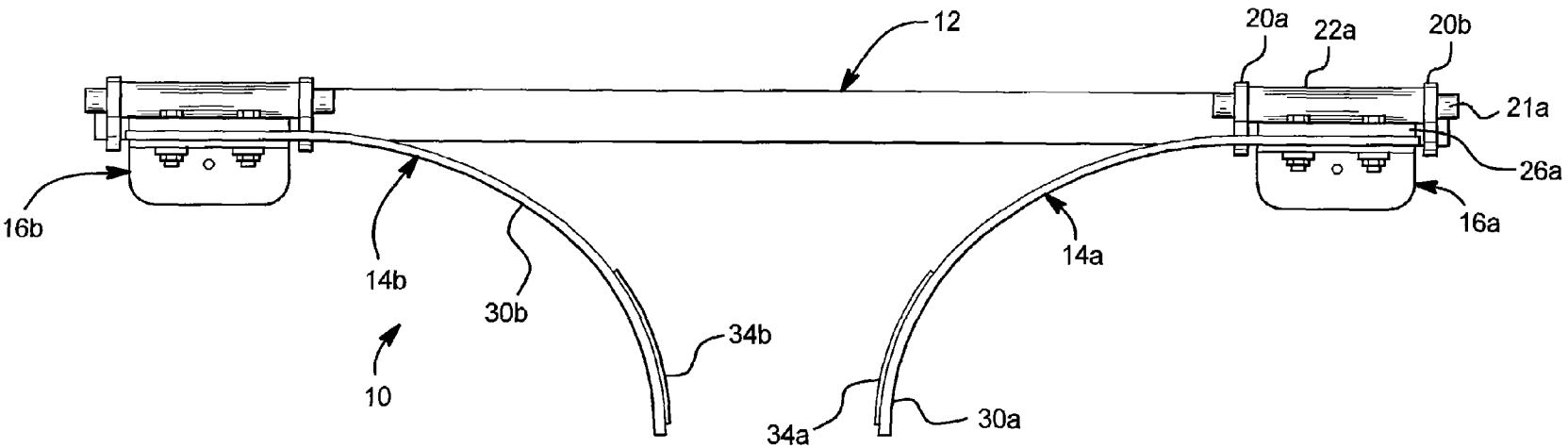
FIG. 2 is front elevation view of the railroad car coupler centering device of FIG. 1.
Figure 3:
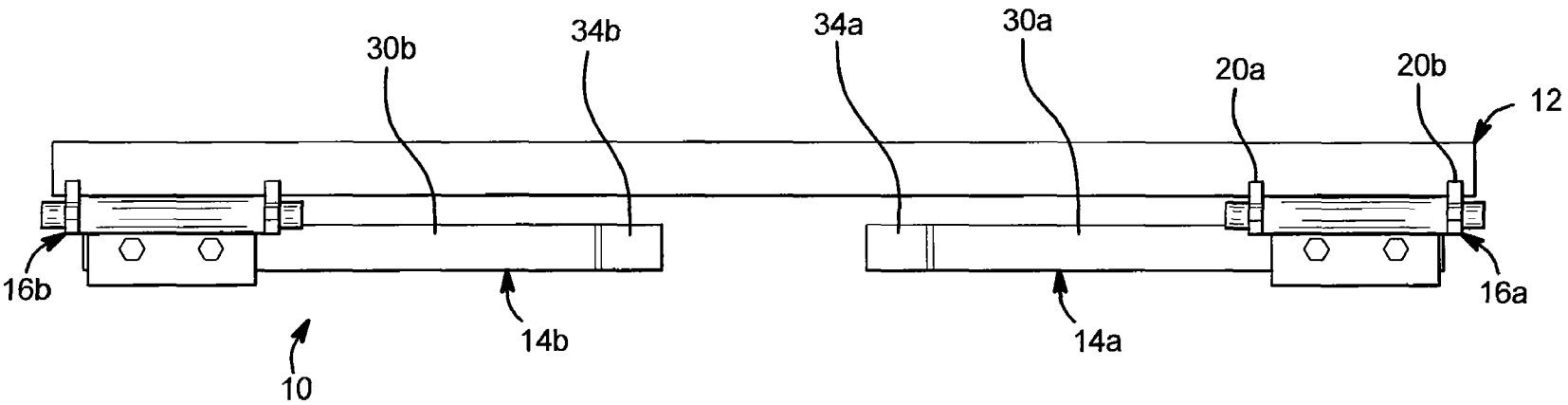
FIG. 3 is top plan view of the railroad car coupler centering device of FIG. 1.
Figure 4:
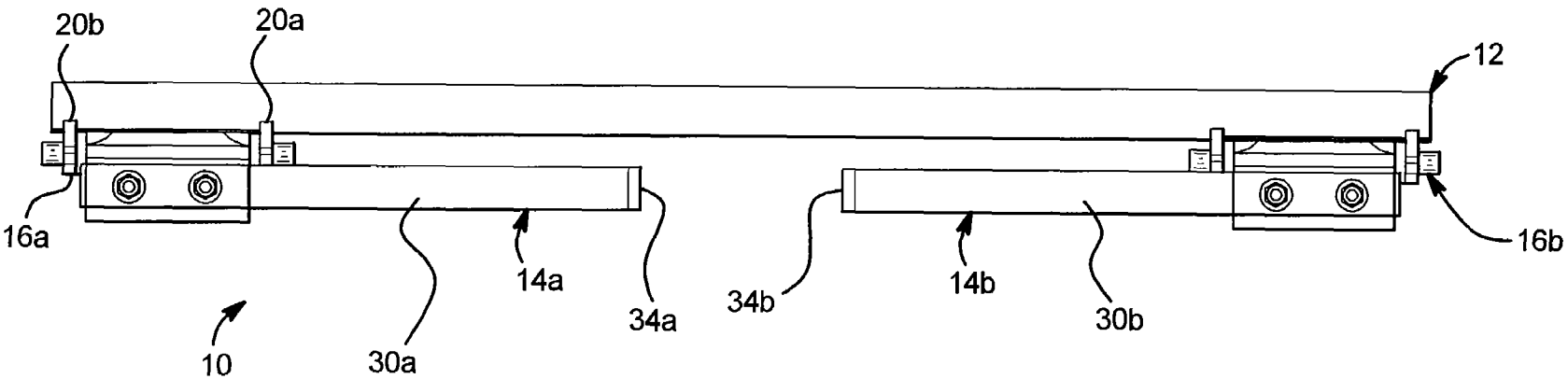
FIG. 4 is bottom plan view of the railroad car coupler centering device of FIG. 1.
Figure 5:
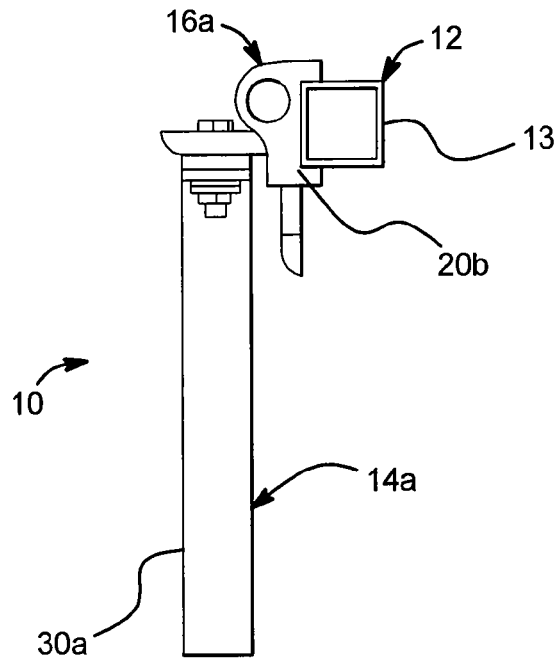
FIG. 5 is right side elevation view of the railroad car coupler centering device of FIG. 1.
Figure 6:
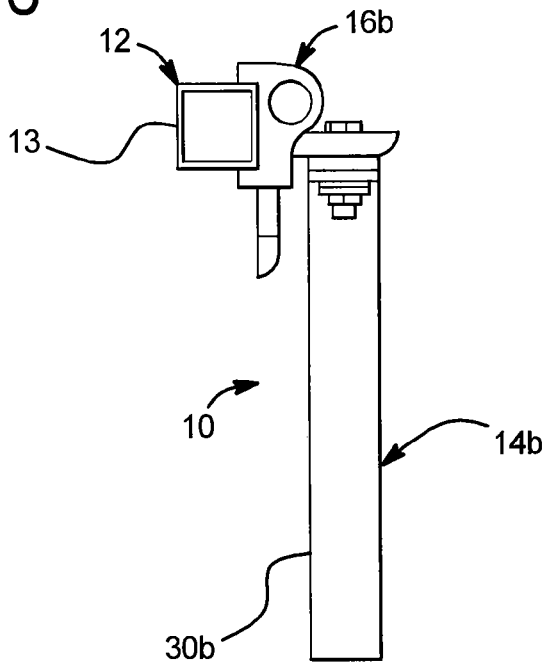
FIG. 6 is left side elevation view of the railroad car coupler centering device of FIG. 1.

Referring now to FIGS. 1 to 11, one embodiment of the railroad car coupler centering device of the present invention is generally indicated by numeral 10. The illustrated embodiment of the coupler centering device 10 includes a spreader beam 12 configured to be suitably mounted to, connected to or affixed to the top of the striker 52 at one end of a railroad car 50 as best illustrated in FIGS. 7A, 7B, 8A, 8B, 9, 10, and 11. The coupler centering device 10 further includes a first or right side centering member or spring 14*a* pivotably connected to the spreader beam 12 by hinge 16*a* and a second or left side centering member or spring 14*b* pivotably connected to the spreader beam 12 by hinge 16*b*. It should be appreciated that the centering members may be otherwise suitably connected to the striker in alternative embodiment.

Figure 7A:
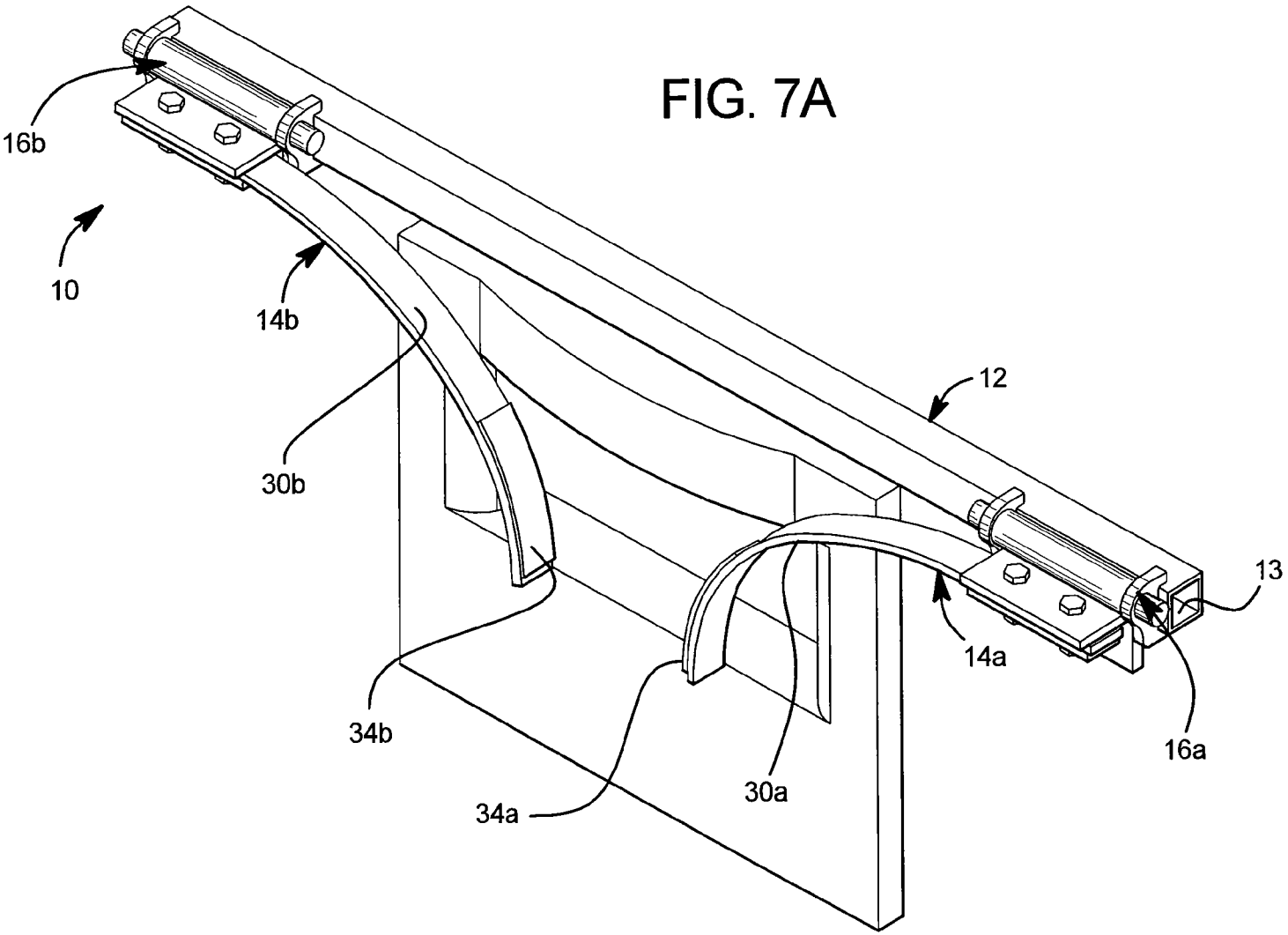
FIG. 7A is a perspective view of the railroad car coupler centering device of FIG. 1 shown mounted on a convention striker of a railroad car (not shown), and illustrating the coupler centering members or springs each in the coupler engaged position.
Figure 7B:
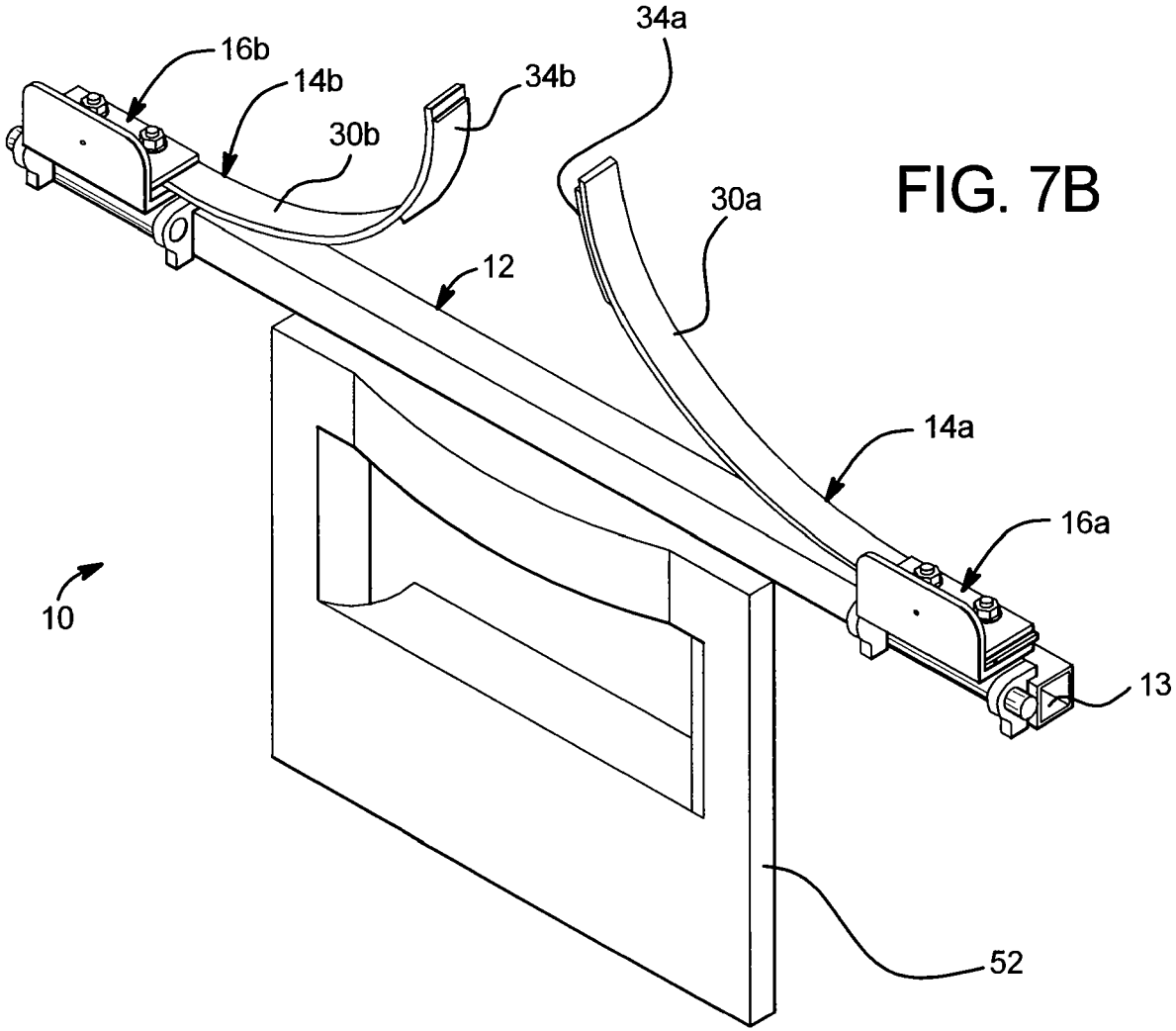
FIG. 7B is a perspective view of the railroad car coupler centering device of FIG. 1 shown mounted on a convention striker of a railroad car (not shown), and illustrating the coupler centering members or springs each in the coupler disengaged position.
Figure 8A:
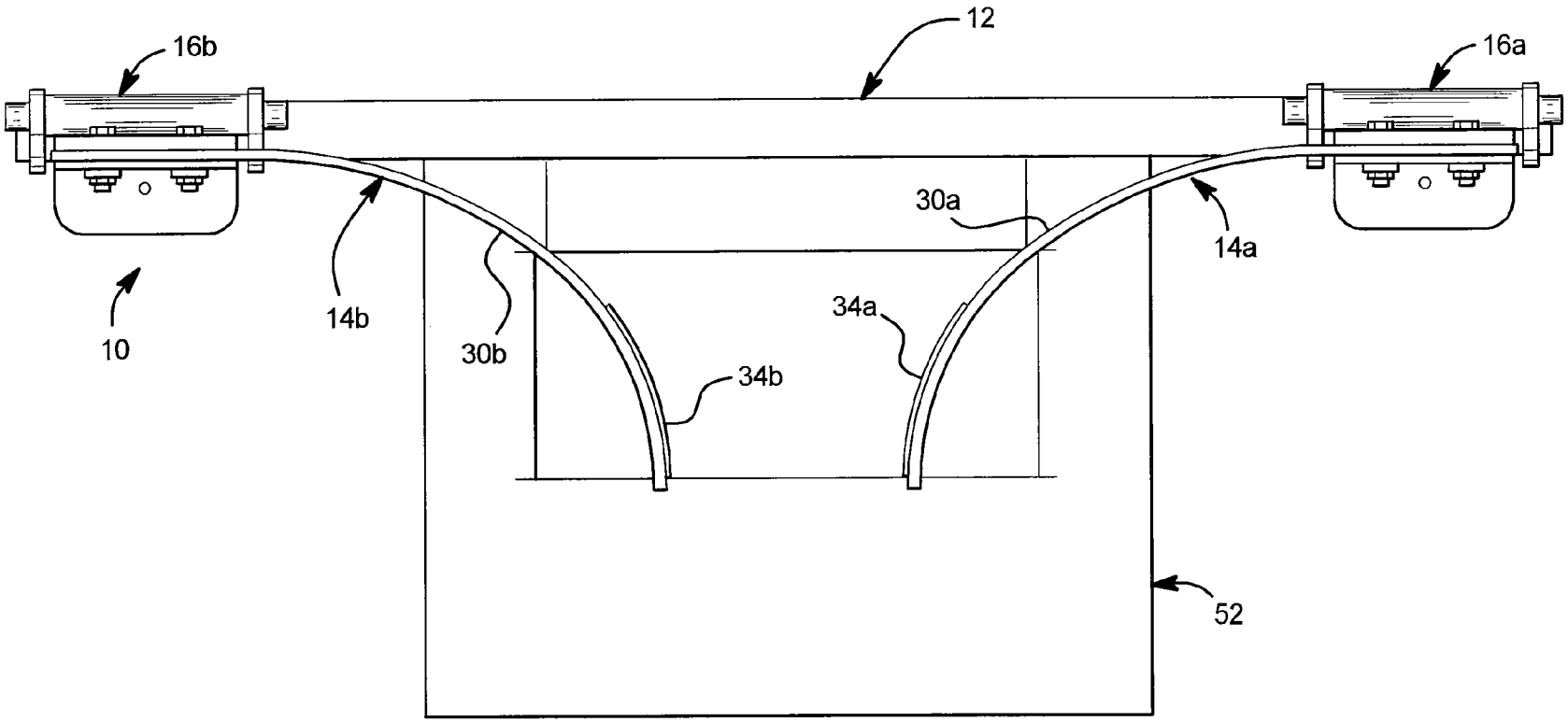
FIG. 8A is a front elevation view of the railroad car coupler centering device of FIG. 1 shown mounted on a convention striker of a railroad car (not shown), and illustrating the coupler centering members or springs each in the coupler engaged position.
Figure 8B:
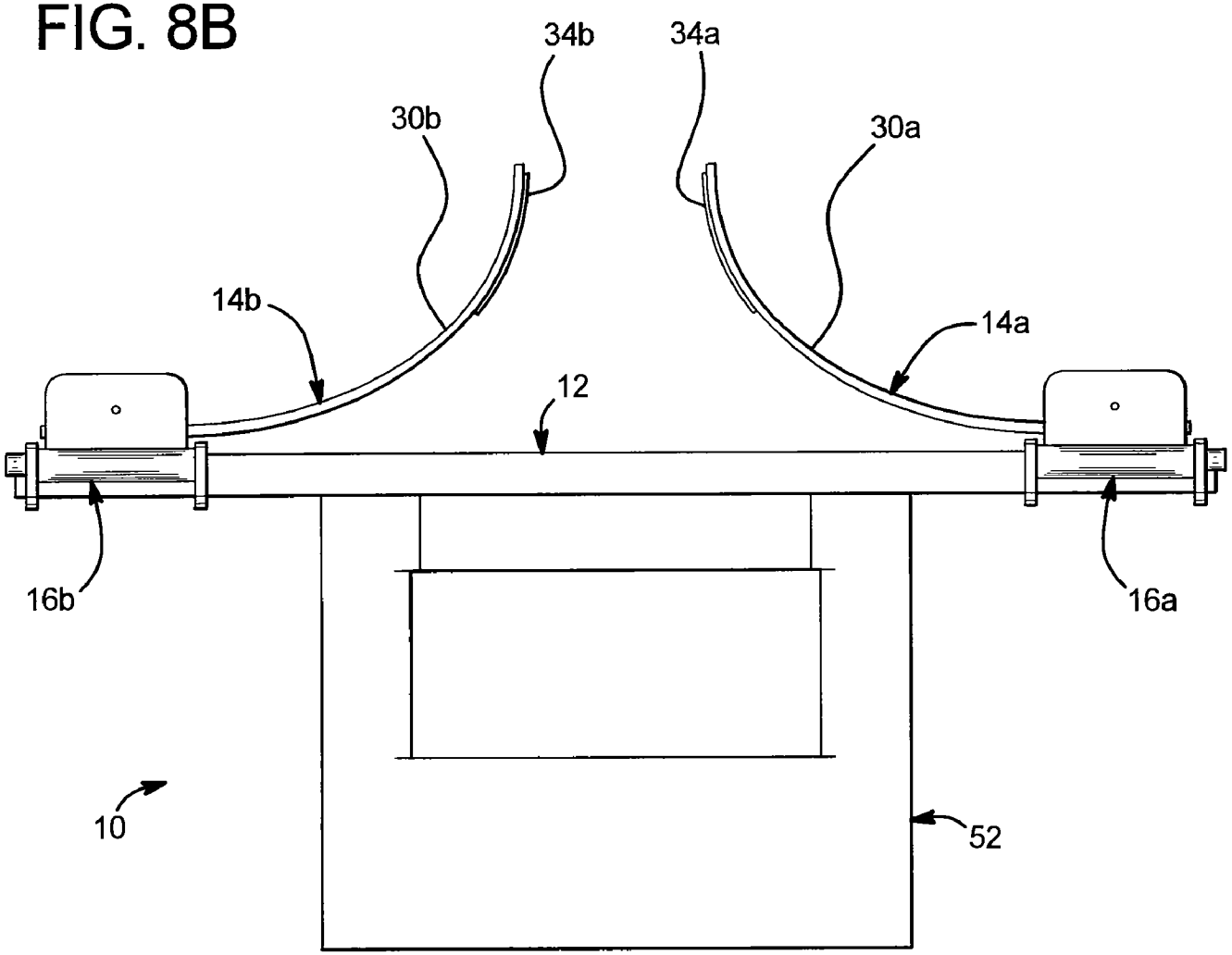
FIG. 8B is a front elevation view of the railroad car coupler centering device of FIG. 1 shown mounted on a convention striker of a railroad car (not shown), and illustrating the coupler centering members or springs each in the coupler disengaged position.
Figure 9:
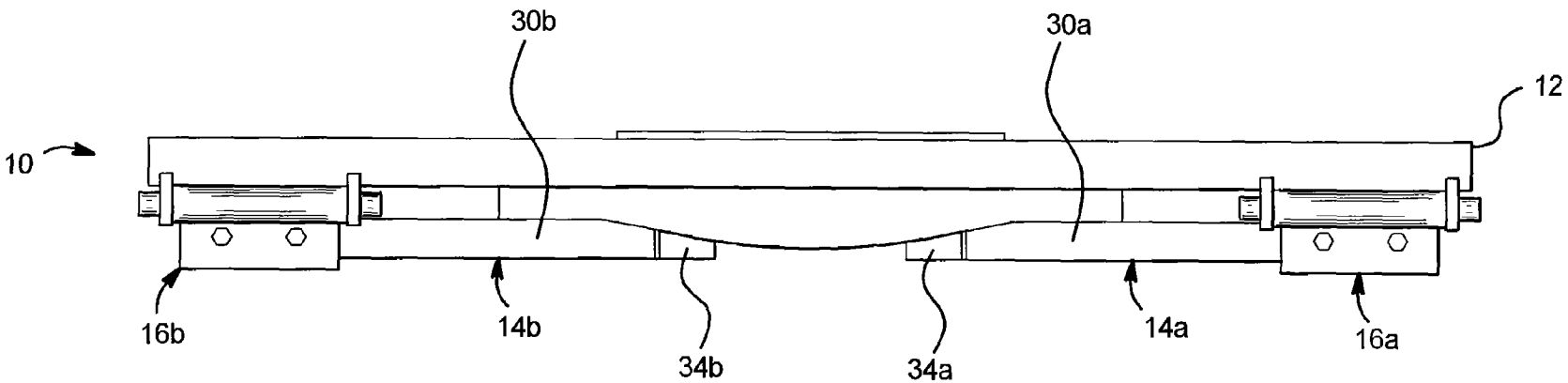
FIG. 9 is a top plan view of the railroad car coupler centering device of FIG. 1 shown mounted on a convention striker of a railroad car (not shown), and illustrating the coupler centering members or springs each in the coupler engaged position.

The first or right side centering spring 14*a* is moveable to and between a coupler engaged position as shown in FIGS. 7A, 8A, 9 and 10 and a coupler disengaged position as shown in FIGS. 7B and 8B. In the coupler engaged position, the right side centering member or spring 14*a* is positioned and configured to engage the right side of the coupler shank 102 (See FIG. 10) (when looking at the railroad car) when the uncoupled coupler moves to the right and is configured to bias the coupler toward the central position. In the coupler disengaged position, the right side centering spring 14*a* allows the uncoupled coupler to move from the center position to the right (not shown).

The first or left side centering spring 14*b* is moveable to and between a coupler engaged position as shown in FIGS. 7A, 8A, 9 and 10 and a coupler disengaged position as shown in FIGS. 7B and 8B. In the coupler engaged position, the left side centering member or spring 14*b* is positioned and configured to engage the left side of the coupler shank 102 (See FIG. 10) (when looking at the railroad car) when the uncoupled coupler moves to the left and is configured to bias the coupler toward the central position. In the coupler disengaged position, the left side centering spring 14*b* allows the uncoupled coupler to move from the center position to the left (not shown). It should be appreciated that when the coupler is coupled to another coupler, the coupler centering device is not strong enough to interfere with the normal movement of the couplers during movement of the railroad cars.

In one embodiment, the spreader beam 12 includes a substantially square elongated tube or tubular member 13 configured to be suitably mounted to, connected to or affixed to the top of the striker at one end of a railroad car as generally illustrated in FIGS. 7A, 7B, 8A, 8B and 9. In one embodiment, the spreader beam is formed from a suitable metal such as steel. This allows the spreader beam to be welded to the steel striker. It should be appreciated that the spreader beam may be formed from other suitable materials and/or attached to the striker in other suitable manners. It should also be appreciated that the spreader beam may be formed in other suitable shapes and sizes. It should further be appreciated that the spreader beam may be formed in multiple sections which are connected together, or may be attached separately or independently to the striker.

In the embodiment illustrated in FIGS. 1 to 11 hinge 16*a* includes two spaced apart hinge brackets 20*a* and 20*b* suitably connected to the spreader beam 12, a hinge pin 21*a* extending through aligned opening in the brackets 20*a* and 20b, a hinge sleeve or hinge barrel 22*a*, and a hinge angle 26*a* suitably connected to the hinge barrel 22*a*.

In the embodiment illustrated in FIGS. 1 to 11, hinge 16*b* is constructed in the same manner as hinge 16*a*, although it could alternatively be constructed in a different manner. In one embodiment, the components of the hinges are made from a suitable metal such as steel. In such case, the hinge brackets are preferably welded to the steel spreader beam and the hinge angle is preferably welded to the hinge barrel. It should be appreciated that the hinges may be formed from other suitable materials and/or attached to the spreader beam in other suitable manners. It should also be appreciated that the hinges may be formed in other suitable configurations, shapes and sizes.

In the illustrated embodiment, the first or right side centering spring 14*a* includes a curved leaf spring 30*a* having opposing ends. The upper or first end is suitably connected to hinge 16*a* and particularly hinge angle 26*a*. In the illustrated embodiment, the first end of the spring 30*a* is connected to the hinge angle 26*a* by two bolts, two nuts and a suitable backing plate. The lower or second end of the leaf spring 30*a* is a free end. In the illustrated embodiment, an engagement pad 34*a* is connected to the engagement side of the leaf spring adjacent to the lower or second end. The engagement pad 34*a* prevents wear on the engagement surfaces of the side of the coupler shank and of the leaf spring.

In the illustrated embodiment, the second or left side centering spring 14*b* includes a curved leaf spring 30*b* and engagement pad 34*b*, is attached in the same manner to hinge 16*b*, and is constructed in the same manner as the right side centering member or spring 14*a*.

In one embodiment, the leaf springs are made from a suitable metal such as steel. In one embodiment, the biasing numbers or leaf springs are formed from flat stock and rolled into suitable curved shape or form to provide the biasing of the coupler. It should be appreciated that the leaf springs may be formed from other suitable materials. It should also be appreciated that the biasing members or leaf springs may be attached to the hinges in other suitable manners. It should further be appreciated that the leaf springs may be formed in other suitable configurations, shapes and sizes. It should further be appreciated that in alternative embodiments, the coupler centering member or springs do not include engagement pads.

In one embodiment, the engagement pads are made from UHMW polyethylene. In one embodiment, the engagement pads are suitably bonded to the leaf springs. In one embodiment, the engagement pads are suitably bonded to mounting members (not shown) which are in turn welded or other wise suitably attached to the leaf springs. It should be appreciated that the engagement pads may be formed from other suitable materials (such as a urethane or a nylon) and/or attached to the leaf spring in other suitable manners. It should also be appreciated that the engagement pads may be formed in other suitable shapes and sizes.

Figure 10:
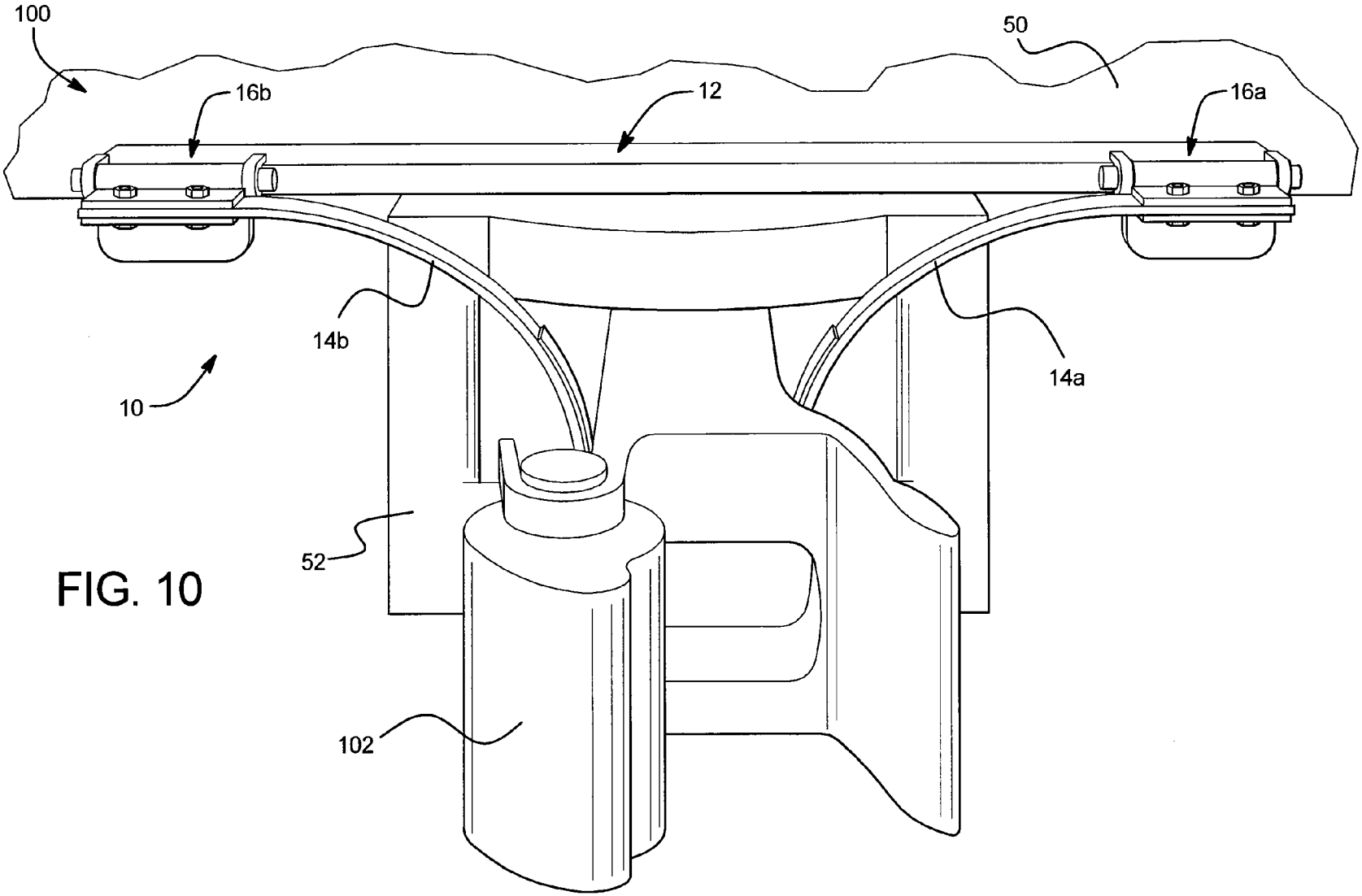
FIG. 10 is a perspective end view of a railroad car having a coupler extending from the end of the railroad car and the railroad car coupler centering device mounted on the striker of the railroad car (shown in fragmentary view), with the coupler centering members or springs each in the coupler engaged position.

Referring now to FIG. 10, a railroad car 100 having a coupler 102 and a coupling centering device 10 is illustrated. The right and left side centering members or springs 14*a* and 14*b* are positioned in their respective coupler engaged positions prior to the coupling process. During the coupling process, the right and left side centering member or springs 14*a* and 14*b* maintain the uncoupled coupler in a centered position even as the railroad car moves on or through one or more curved sections of the track. The right and left side centering members or springs 14*a* and 14*b* can remain in the coupler engaged positions during subsequent movement because the leaf springs 30*a* and 30*b* do not interfere with the movement of couplers during normal movement of the connected railroad cars because the leaf spring are not strong enough to prevent lateral movement of the coupler in such situations.

Figure 11:
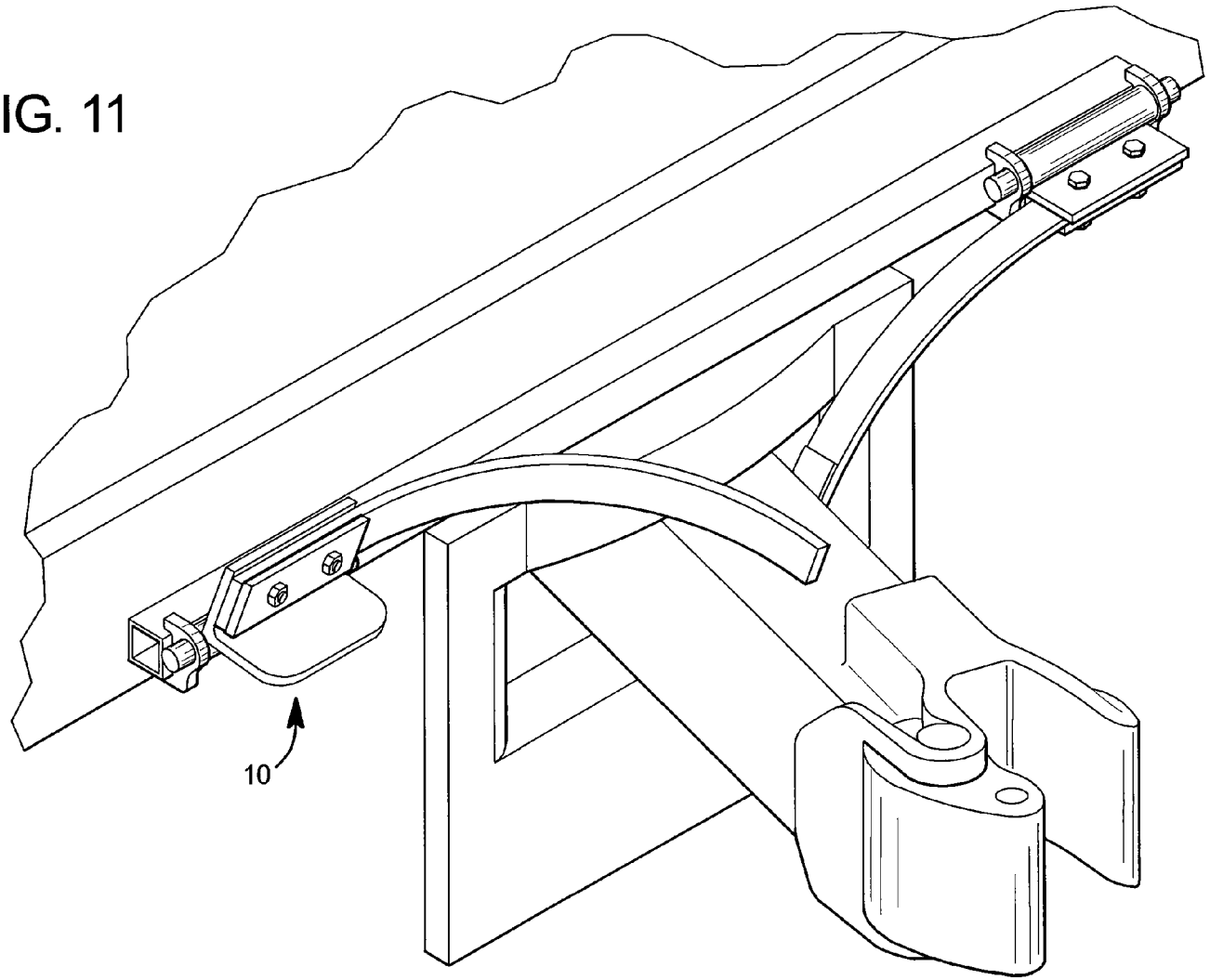
FIG. 11 is a perspective end view of a railroad car having a coupler extending from the end of the railroad car (shown in fragmentary view) and the railroad car coupler centering device mounted on the striker of the railroad car, with the left hand coupler centering member or spring resting on top of the coupler shaft.
Figure 12:
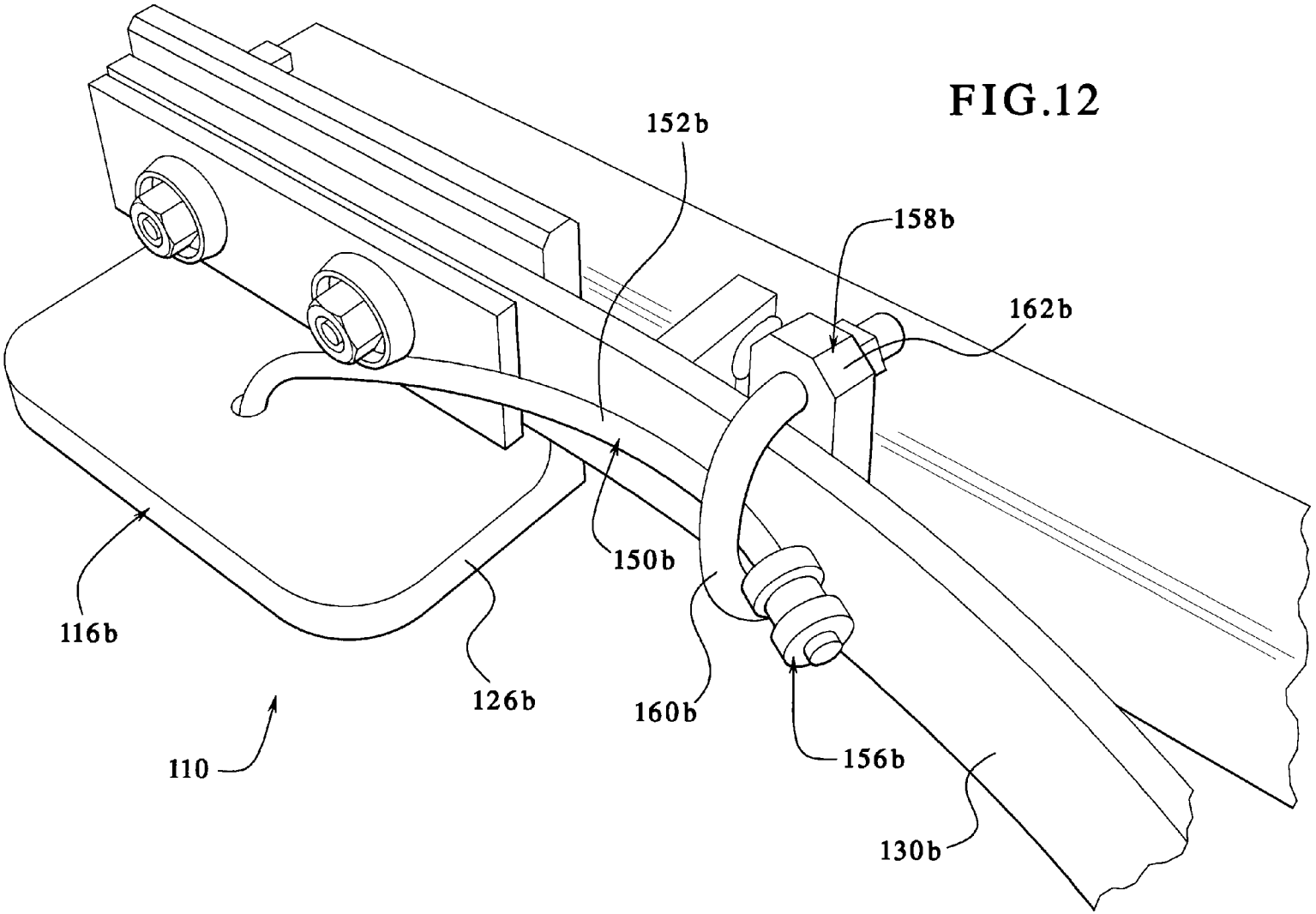
FIG. 12 is a top perspective fragmentary view of the left side of coupler centering device of an alternative embodiment of the present invention showing a securing assembly including a tether connecting the left side spring (shown in the disengaged position) to the left side hinge for preventing the left side spring from falling on the railroad tracks in case the left side spring breaks.
Figure 13:
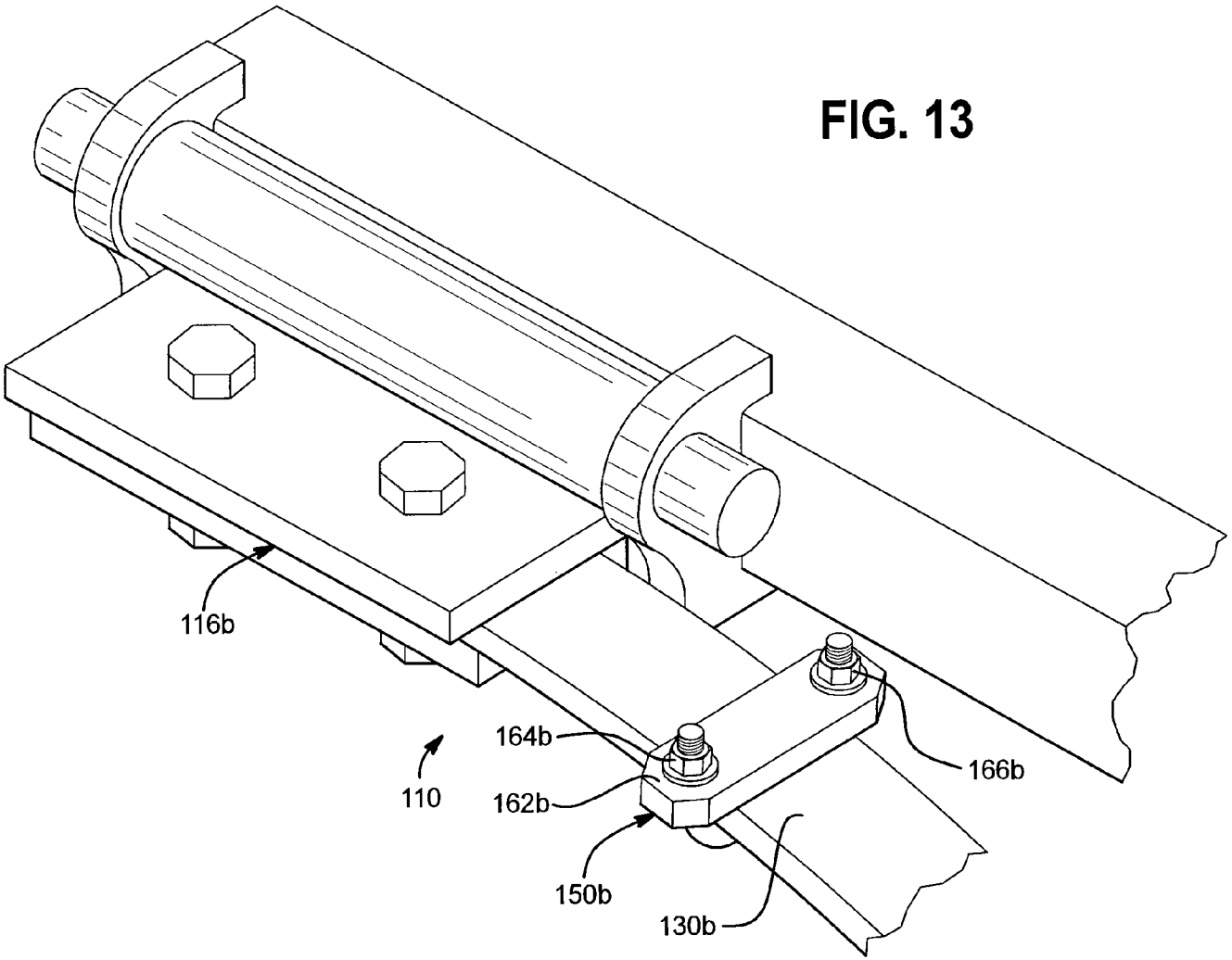
FIG. 13 is a top perspective fragmentary view of the left side of coupler centering device of the alternative embodiment of FIG. 12, where the left side spring is in the engaged position.
Figure 14:
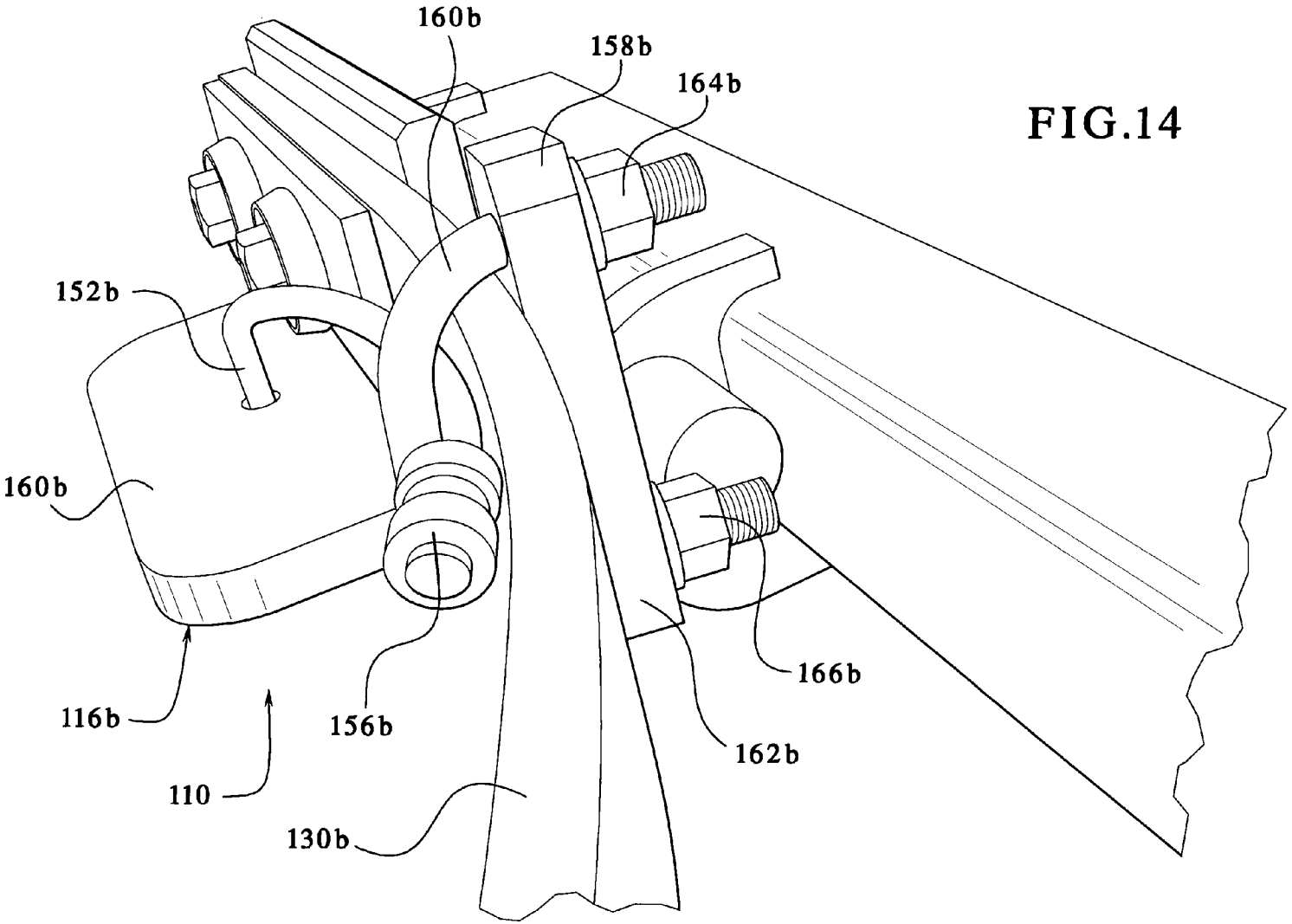
FIG. 14 is a side perspective fragmentary view of the left side of coupler centering device of the alternative embodiment of FIG. 12, where the left side spring is in the disengaged position.
Figure 15:
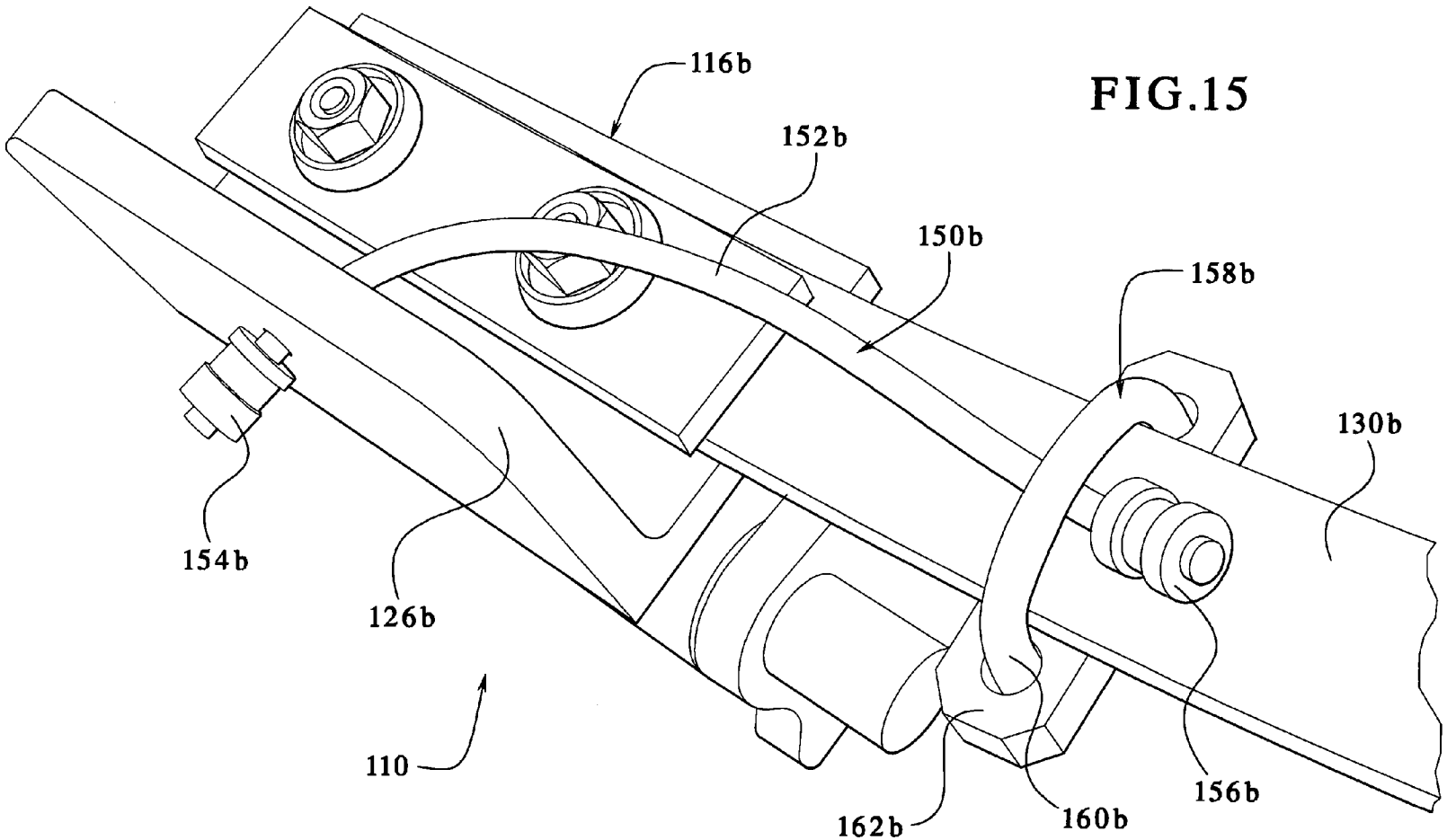
FIG. 15 is a front perspective fragmentary view of the left side of coupler centering device of the alternative embodiment of FIG. 12, where the left side spring is in the disengaged position.
Figure 16A:
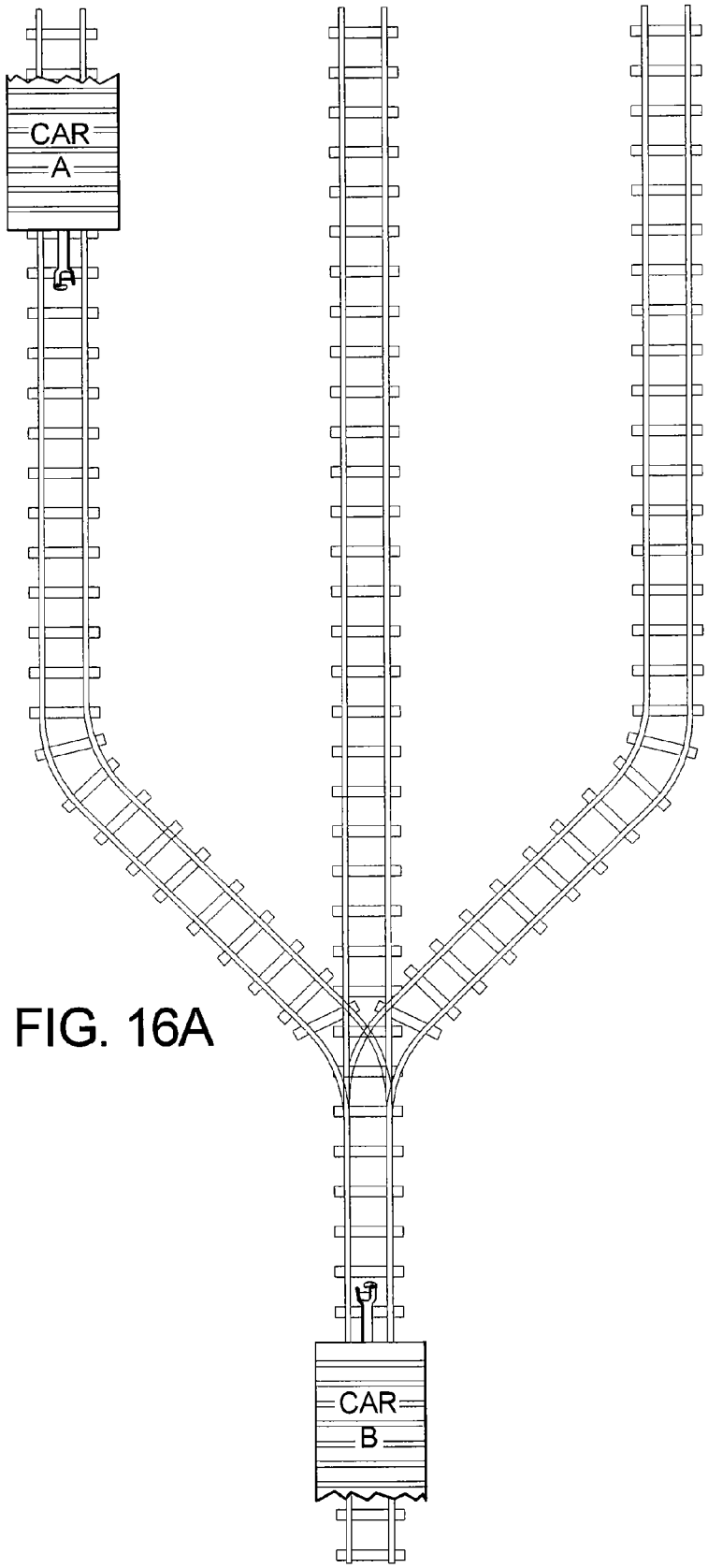
FIGS. 16A, 16B and 16C are diagrammatic top plan views of a coupling process in a railroad yard.
Figure 16B:
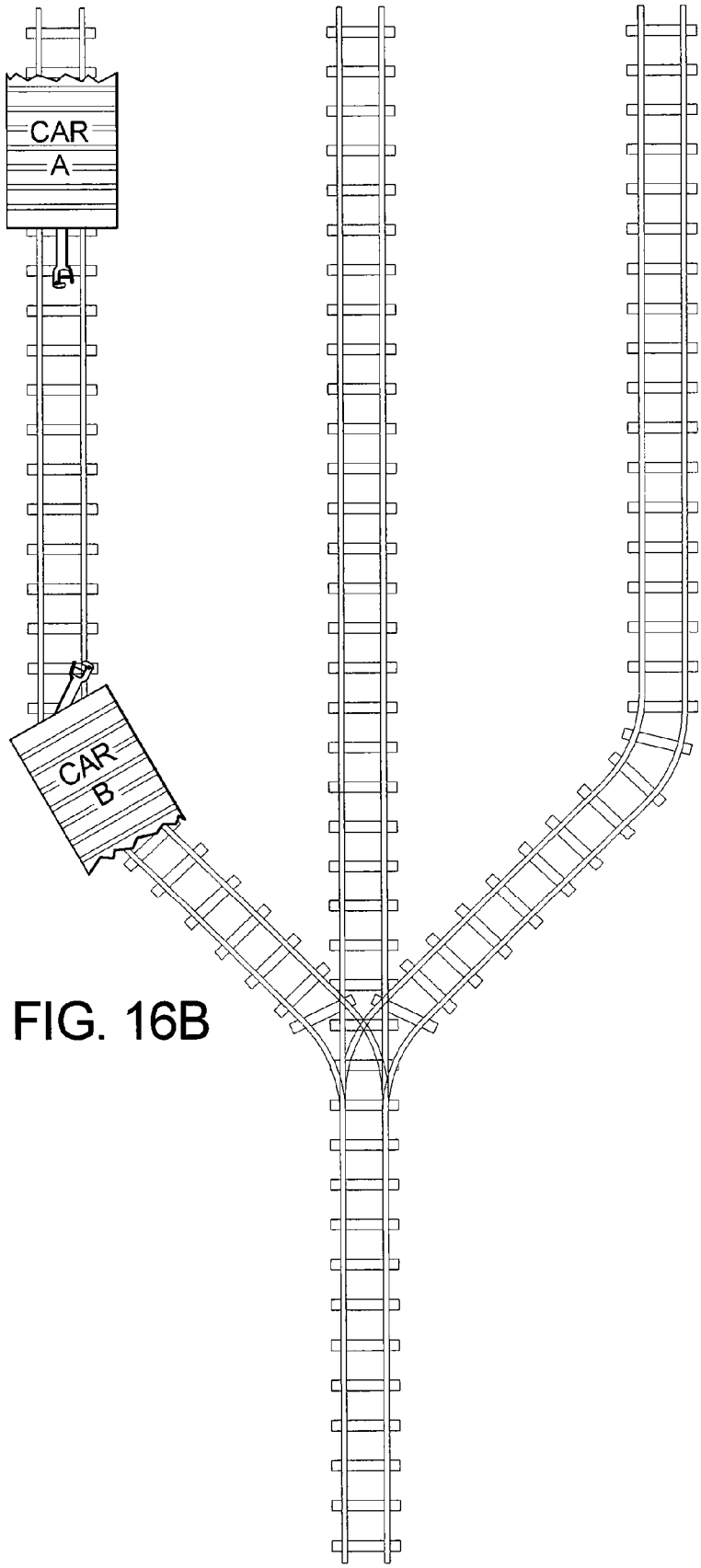
Figure 16C:
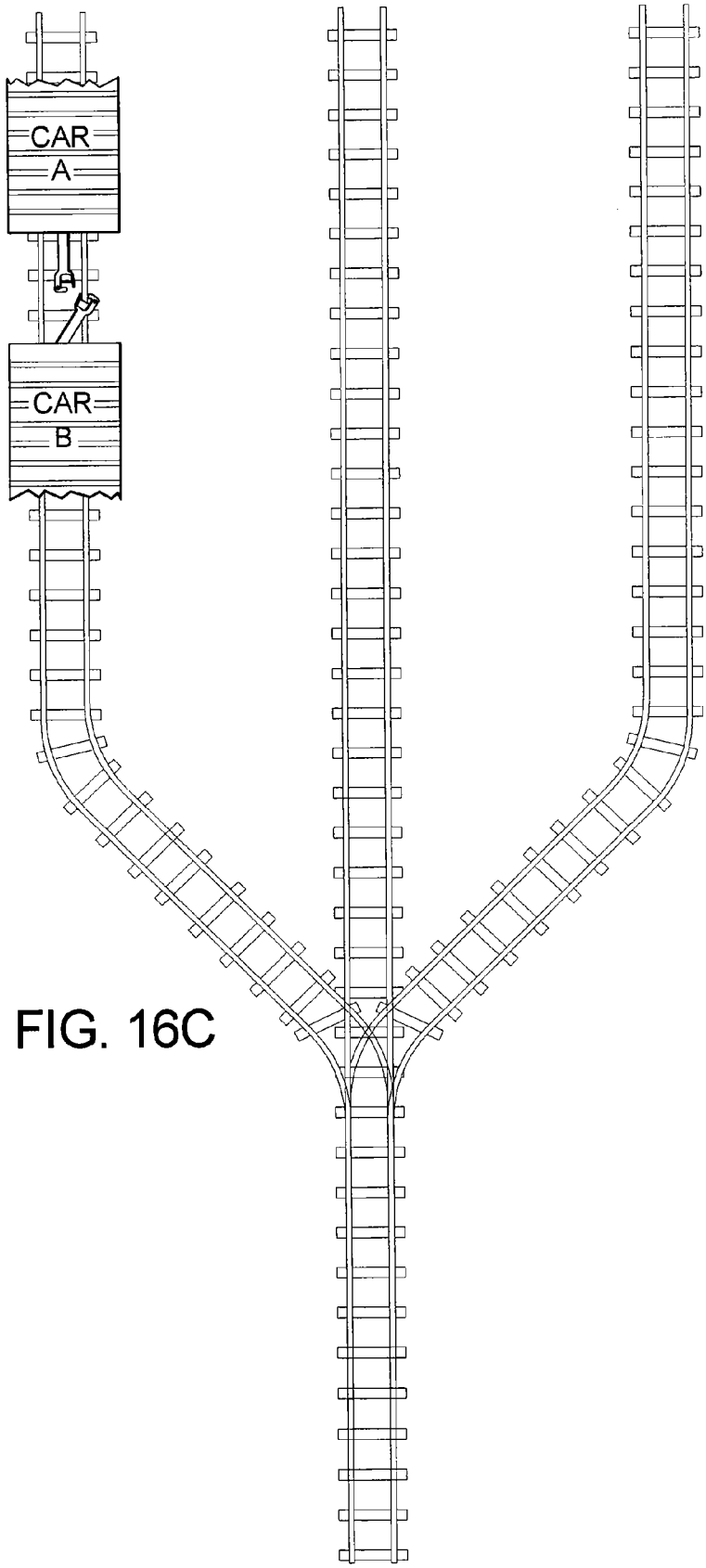
Figure 17A:
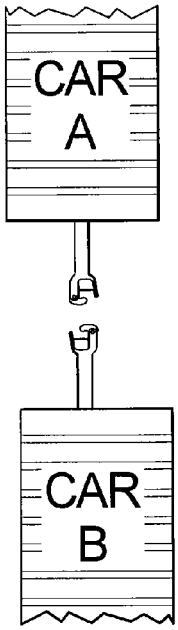
FIG. 17A is a diagrammatic top plan view which illustrates adjacent railroad cars with couplers in alignment.
Figure 17B:
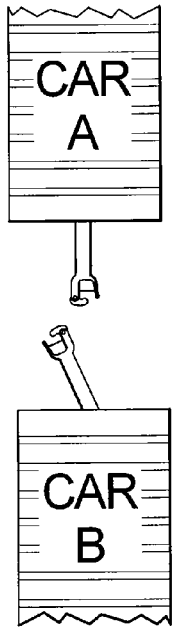
FIGS. 17B, 17C, 17D, 17E and 17F are diagrammatic top plan views which each illustrate adjacent railroad cars with misaligned couplers.
Figure 17C:
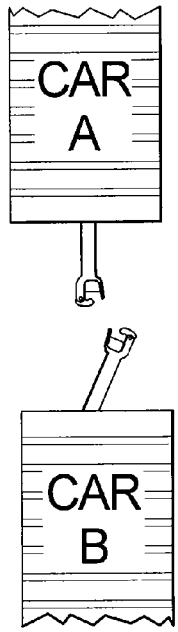
Figure 17D:
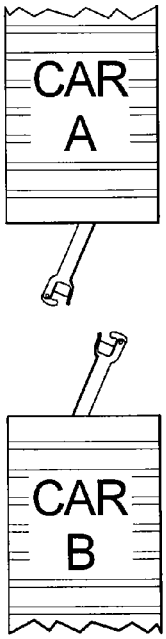
Figure 17E:
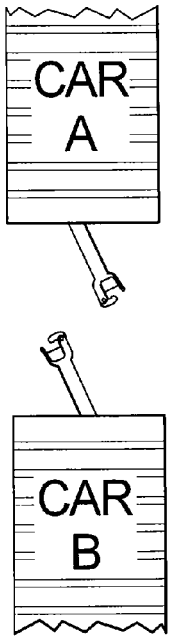
Figure 17F:
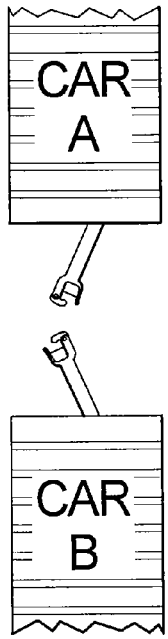

The right and left side centering members or springs 14*a* and 14*b* are each independently moveable (i.e., about the respective hinges 16*a* and 16*b*) to the coupler disengaged positions as illustrated in FIG. 11 to allow for the manual movement of the couplers to the left and to the right. In other words, if the coupler needs to be moved to right, the right side centering member or spring 14*a* is easily manually moved (i.e., lifted by pivoting or rotating) about the hinge 16*a* to its coupler disengaged position. Likewise, if the coupler needs to be moved to the left, the left side centering member or spring 14*b* is easily manually moved (i.e., lifted by pivoting or rotating) about the hinge 16*b* to its coupler disengaged position, such as when railroad cars are coupled on a curved section of track.

In one embodiment, if the right and left side centering members or springs are in the lifted or non-engaged positions, movement of the railroad car will cause the right and left side centering members to each move downwardly to one of two respective positions. The first position is the coupler engaged position. The second position is on top of the coupler if the coupler is under the centering spring (as seen in FIG. 11). When the coupler and coupler shank move in the opposite direction or the centered position, the centering spring will drop into place. It should also be appreciated that the spring may also drop into place when the railroad cars are coupled together depending on the force of the coupling.

Referring now to FIGS. 12, 13, 14 and 15, in one alternative embodiment, the coupler centering device 110 includes a securing assembly (not shown) attached to the first or right side centering member or spring and the hinge and a securing assembly 150*b* attached to second or left side centering member or spring 130*b* and hinge 116*b*. The securing assemblies respectively prevent broken leaf springs from being disconnected from the railroad car. Any Suitable securing assembly may be employed.

More specifically, the illustrated embodiment of the securing assembly 150*b* includes a cable or tether 152*b* connected to the hinge 116*b* at one end and connected to the leaf spring 130*b* at the other end in a conventional manner. The cable or tether 152*b* includes suitable caps 154*b* and 156*b* secured to each end. The cable or tether 152*b* extends through a hole or aperture in the hinge angle 126*b* such that the cap 154*b* engages the hinge angle 126*b* to secure the cable or tether 152*b* to the hinge angle. The other end of the cable or tether 152*b* extends though a locking member 158*b* such that the cap 156*b* secures the cable or tether 152*b* to the leaf spring 130*b*. The locking illustrated member 158*b* includes a U-shaped connection bar 160*b* having threaded ends, a locking bar 162*b* and fasteners 164*b* and 166*b* (such as nuts) which secure the connection bar and locking bar to the leaf spring 130*b*. It should be appreciated that other suitable devices can be employed as the locking member. It should also be appreciated that other suitable securing assemblies may be employed in accordance with the present invention. It should thus be appreciated that if the leaf spring breaks, the cable or tether will maintain the broken leaf spring attached to the hinge.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A railroad car coupler centering device comprising:

a spreader beam configured to be mounted to a striker of a railroad car having a coupler extending from an end of the railroad car;

a right side centering spring pivotally connected to the spreader beam by a right side hinge such that when said spreader beam is mounted to said striker, said right side centering spring is moveable about the right side hinge to:

(a) a coupler engaged position to engage the right side of the coupler and to bias the coupler to a central position, and (b) a coupler disengaged position away from the coupler to allow the coupler to move from the central position to the right; and a left side centering spring pivotally connected to the spreader beam by a left side hinge such that when said spreader beam is mounted to said striker, said left side centering spring is moveable about the left side hinge to:

(a) a coupler engaged position to engage the left side of the coupler and to bias the coupler to the central position, and (b) a coupler disengaged position away from the coupler to allow the coupler to move from the central position to the left.

2. The railroad car coupler centering device of claim 1, wherein the spreader beam includes an elongated tube.

3. The railroad car coupler centering device of claim 1, wherein the spreader beam includes multiple sections.

4. The railroad car coupler centering device of claim 1, wherein the right side centering spring includes a right side curved leaf spring configured to engage the coupler, and the left side centering spring includes a left side curved leaf spring configured to engage the coupler.

5. The railroad car coupler centering device of claim 4, wherein the right side curved leaf spring includes a first end connected to the right side hinge and a second free end configured to engage the coupler, and the left side curved leaf spring include a first end connected to the left side hinge and a second free end configured to engage the coupler.

6. The railroad car coupler centering device of claim 5, wherein the right side centering spring includes a right side coupler engagement pad connected to the free end of the right side leaf spring and configured to engage the coupler, and the left side centering spring includes a left side coupler engagement pad connected to the free end of the left side leaf spring and configured to engage the coupler.

7. The railroad car coupler centering device of claim 4, wherein the right side centering spring includes a right side securing cable connected to the right side hinge and the right side leaf spring, and the left side centering spring includes a left side securing cable connected to the left side hinge and the left leaf spring.

8. The railroad car coupler centering device of claim 1, wherein the right side centering spring includes a right side coupler engagement pad, and the left side centering spring includes a left side coupler engagement pad.

9. A railroad car coupler centering device comprising:

a spreader beam configured to be mounted to a striker of a railroad car having a coupler extending from an end of the railroad car;

a right side centering spring pivotally connected to the spreader beam by a right side hinge, said right side centering spring including:

(a) a right side curved leaf spring having a first end connected to the right side hinge and a second free end configured to engage the coupler, (b) a right side securing cable connected to the right side hinge and the right side leaf spring; and a left side centering spring pivotally connected to the spreader beam by a left side hinge, said left side centering spring including:

(a) a left side curved leaf spring having a first end connected to the left side hinge and a second free end configured to engage the coupler, and (b) a left side securing cable connected to the left side hinge and the left leaf spring.

10. The railroad car coupler centering device of claim 9, wherein the spreader beam includes an elongated tube.

11. The railroad car coupler centering device of claim 9, wherein the spreader beam includes multiple sections.

12. The railroad car coupler centering device of claim 9, wherein the right side centering spring includes a right side coupler engagement pad connected to the free end of the right side leaf spring and configured to engage the coupler, and the left side centering spring includes a left side coupler engagement pad connected to the free end of the left side leaf spring and configured to engage the coupler.

13. A railroad car coupler centering device comprising:

a spreader beam configured to be mounted to a striker of a railroad car having a coupler extending from an end of the railroad car;

a right side centering spring pivotally connected to the spreader beam by a right side hinge, said right side centering spring including:

(a) a right side curved leaf spring having a first end connected to the right side hinge and a second free end configured to engage the coupler, (b) a right side coupler engagement pad connected to the free end of the right side leaf spring; and a left side centering spring pivotally connected to the spreader beam by a left side hinge, said left side centering spring including:

(a) a left side curved leaf spring having a first end connected to the left side hinge and a second free end configured to engage the coupler, and (b) a left side coupler engagement pad connected to the free end of the left side leaf spring.

14. The railroad car coupler centering device of claim 13, wherein the spreader beam includes an elongated tube.

15. The railroad car coupler centering device of claim 13, wherein the spreader beam includes multiple sections.

16. A railroad car coupler centering device comprising:

a right side biasing member configured to be pivotally connected to a striker of a railroad car having a coupler extending from an end of the railroad car, such that said right side biasing member is moveable about said pivotal connection to:

(a) a coupler engaged position to biasingly engage a right side of the coupler toward a central position, and (b) a coupler disengaged position away from the coupler to allow the coupler to move from the central position to the right; and a left side biasing member configured to be pivotally connected to said striker such that said left side biasing member is moveable about said pivotal connection to:

(a) a coupler engaged position to biasingly engage a left side of the coupler and bias the coupler toward the central position, and (b) a coupler disengaged position away from the coupler to allow the coupler to move from the central position to the left.

17. The railroad car coupler centering device of claim 16, which includes a right side hinge configured to pivotally connect the right side biasing member to the striker, and a left side hinge configured to pivotally connect the left side biasing member to the striker.

18. The railroad car coupler centering device of claim 16, wherein the right side biasing member includes a curved leaf spring, and the left side biasing member includes a curved leaf spring.

19. A railroad car coupler centering device comprising:

a right side hinge;

a right side centering spring configured to be pivotally connected by the right side hinge to a striker of a railroad car having a coupler extending from an end of the railroad car, such that said right side centering spring is moveable about the right side hinge to:

(a) a coupler engaged position to engage the right side of the coupler and to bias the coupler to a central position, and (b) a coupler disengaged position away from the coupler to allow the coupler to move from the central position to the right;

a left side hinge; and a left side centering spring configured to be pivotally connected by the left side hinge to said striker such that said left side centering spring is moveable about the left side hinge to:

(a) a coupler engaged position to engage the left side of the coupler and to bias the coupler to the central position, and (b) a coupler disengaged position away from the coupler to allow the coupler to move from the central position to the left.

20. The railroad car coupler centering device of claim 19, wherein the right side centering spring includes a right side curved leaf spring configured to engage the coupler, and the left side centering spring includes a left side curved leaf spring configured to engage the coupler.

21. The railroad car coupler centering device of claim 19, wherein the right side curved leaf spring includes a first end connected to the right side hinge and a second free end configured to engage the coupler, and the left side curved leaf spring includes a first end connected to the left side hinge and a second free end configured to engage the coupler.

22. The railroad car coupler centering device of claim 21, wherein the right side centering spring includes a right side coupler engagement pad connected to the free end of the right side leaf spring and configured to engage the coupler, and the left side centering spring includes a left side coupler engagement pad connected to the free end of the left side leaf spring and configured to engage the coupler.

23. The railroad car coupler centering device of claim 22, wherein the right side centering spring includes a right side securing cable connected to the right side hinge and the right side leaf spring, and the left side centering spring includes a left side securing cable connected to the left side hinge and the left leaf spring.

24. The railroad car coupler centering device of claim 19, wherein the right side centering spring includes a right side coupler engagement pad, and the left side centering spring includes a left side coupler engagement pad.

25. A railroad car coupler centering device comprising:

a right side hinge;

a right side centering spring configured to be pivotally connected by the right side hinge to a striker of a railroad car having a coupler extending from an end of the railroad car, said right side centering spring including:

(a) a right side curved leaf spring having a first end connected to the right side hinge and a second free end configured to engage the coupler, (b) a right side securing cable connected to the right side hinge and the right side leaf spring;

a left side hinge; and a left side centering spring configured to be pivotally connected by the left side hinge to said striker of the rail road car, said left side centering spring including:

(a) a left side curved leaf spring having a first end connected to the left side hinge and a second free end configured to engage the coupler, and (b) a left side securing cable connected to the left side hinge and the left leaf spring.

26. The railroad car coupler centering device of claim 25, wherein the right side centering spring includes a right side coupler engagement pad connected to the free end of the right side leaf spring and configured to engage the coupler, and the left side centering spring includes a left side coupler engagement pad connected to the free end of the left side leaf spring and configured to engage the coupler.

27. A railroad car coupler centering device comprising:

a right side hinge;

a right side centering spring configured to be pivotally connected by the right side hinge to a striker of a railroad car having a coupler extending from an end of the railroad car, said right side centering spring including:

(a) a right side curved leaf spring having a first end connected to the right side hinge and a second free end configured to engage the coupler, (b) a right side coupler engagement pad connected to the free end of the right side leaf spring;

a left side hinge; and a left side centering spring configured to be pivotally connected by the left side hinge to said striker of the rail road car, said left side centering spring including:

(a) a left side curved leaf spring having a first end connected to the left side hinge and a second free end configured to engage the coupler, and (b) a left side coupler engagement pad connected to the free end of the left side leaf spring.

* * * * *